US005088284A

United States Patent [19]

Momose

[11] Patent Number: 5,088,284

[45] Date of Patent: Feb. 18, 1992

[54] COMPRESSOR INTEGRAL WITH STIRLING ENGINE

[75] Inventor: Yutaka Momose, Anjo, Japan

[73] Assignee: Aisin Seiki Kabushiki Kaisha, Kariya, Japan

[21] Appl. No.: 672,635

[22] Filed: Mar. 20, 1991

[30] Foreign Application Priority Data

Mar. 21, 1990 [JP] Japan ..... 2-71692

[51] Int. Cl.[5] ..... F02G 1/043

[52] U.S. Cl. ..... 60/517

[58] Field of Search ..... 60/517-526

[56] References Cited

U.S. PATENT DOCUMENTS 4,751,819 6/1988 Eder ..... 60/517

*Primary Examiner*—Allen M. Ostrager

*Attorney, Agent, or Firm*—Burns, Doane, Swecker & Mathis

[57] ABSTRACT

There is disclosed an oil-free compressor integral with a Stirling engine. The compressor is used as an air compressor or in air-conditioning equipment. The Stirling engine has a cylinder in which a displacer piston is slidable. An expansion space and a compression space are formed on opposite sides of the piston. The compressor comprises a first pressure chamber communicating with the compression space, a second pressure chamber connected with a Rankine heat pump circuit via valves, a first buffer chamber communicating with the compression space via a first orifice, and a second buffer chamber connected with the second pressure chamber via a second orifice. The first pressure chamber is partitioned from the second pressure chamber by a first diaphragm. The first buffer chamber is partitioned from the second buffer chamber by a second diaphragm. These two diaphragms are connected together by a rod such that they move together axially. The pressure acting on one side of each diaphragm is balanced by the pressure acting on the other side.

2 Claims, 1 Drawing Sheet

Figure
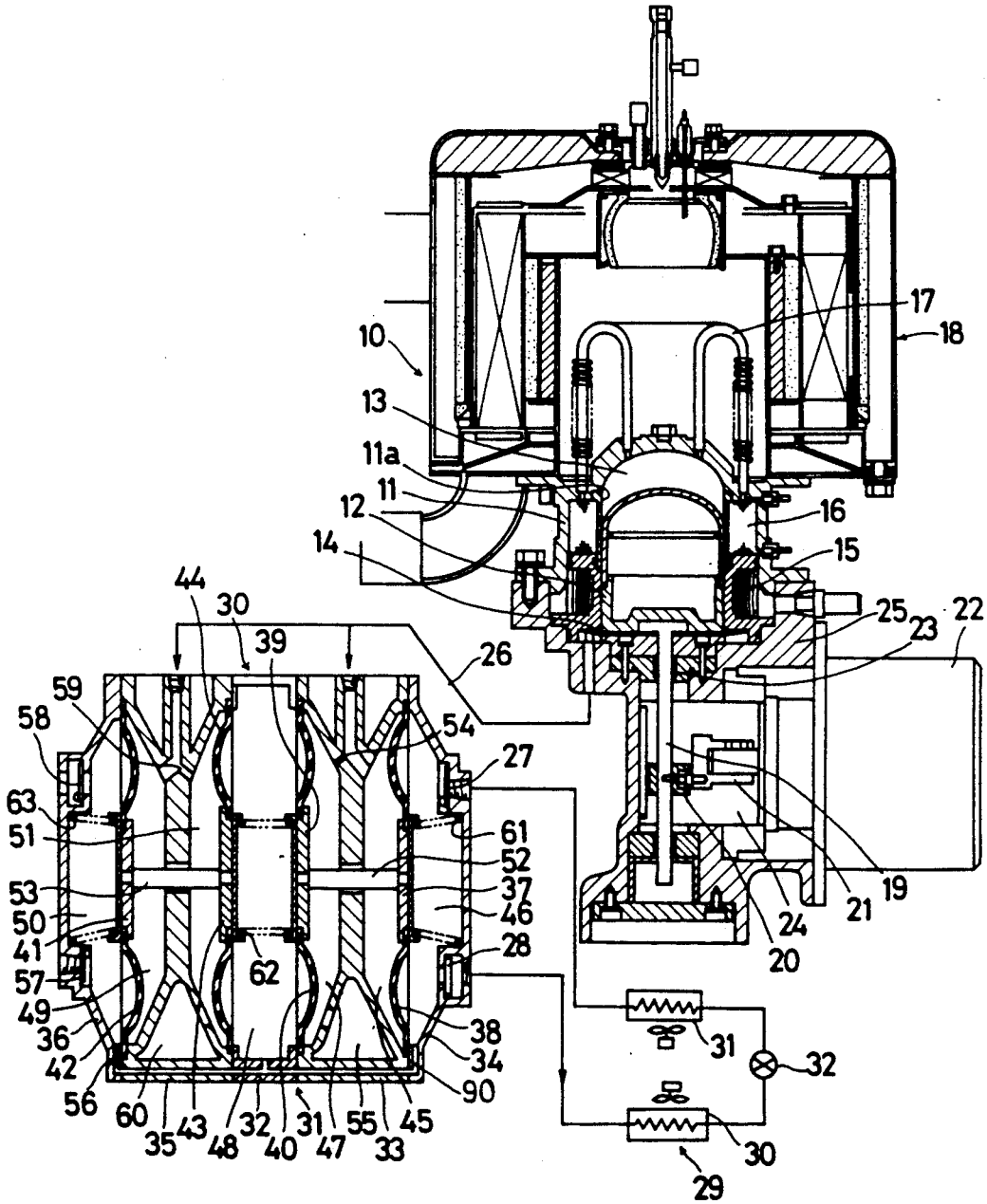

COMPRESSOR INTEGRAL WITH STIRLING ENGINE

FIELD OF THE INVENTION

The present invention relates to a compressor which is integral with a Stirling engine and driven by combustion heat or waste heat produced from fossil fuel, solar heat, or other heat source and which is used as an oil-free air compressor or as an oil-free compressor in air-conditioning equipment.

BACKGROUND OF THE INVENTION

A compressor of this kind has been disclosed in West German Offenlegungsschrift 3 314 705. This compressor transforms changes in the pressure inside the compression space of a Stirling engine into axial displacement of a diaphragm. The axial displacement produces pumping action, whereby the fluid inside the fluid circuit is compressed or circulated.

In this conventional compressor, only the pressure of the working gas inside the working space of the Stirling engine and the pressure of the fluid inside the fluid circuit act on the opposite sides of the diaphragm. Therefore, if the average pressures on both sides of the diaphragm differ, it is displaced toward the lower pressure side. This impedes axial displacement of the diaphragm if the pressure inside the compression space varies. Thus, no pumping action takes place. Furthermore, no Stirling cycle is created, because the changing pressure of the working space including the expansion space and the compression space is in phase with the axial displacement of the diaphragm. Hence, the output of the Stirling engine cannot be efficiently used in the compressor.

SUMMARY OF THE INVENTION

It is an object of the invention to provide a compressor which is integral with a Stirling engine, is simple in structure, ensures that pumping action occurs if the average pressure of the working gas inside the working space of the Stirling engine differs from the average pressure of the fluid inside the fluid circuit, and permits the output of the Stirling engine to be efficiently utilized by the compressor.

The above object is achieved in accordance with the teachings of the invention by a compressor integral with a Stirling engine having a cylinder, said compressor comprising: a displacer piston slidably inserted in the cylinder; an expansion space formed on one side of the piston; a compression space formed on the other side of the piston, the compression space being in communication with the expansion space through heat transfer tubes, a regenerator, and a cooler, the heat transfer tubes being heated by a heat source; a first resilient member whose outer fringe is hermetically held to a casing; a first pressure chamber which is formed on one side of the first resilient member and in communication with the compression space; a second pressure chamber which is formed on the other side of the first resilient member and in communication with a fluid circuit through an inlet-and-exhaust valve mechanism; a second resilient member whose outer fringe is hermetically held to the casing; a first buffer chamber formed between one side of the second resilient member and a partition wall formed in the casing, the first buffer chamber being partitioned from the first pressure chamber by the second resilient member, the first buffer chamber being in communication with the compression space via a first attenuation means; a second buffer chamber which is formed on the other side of the second resilient member and in communication with the second pressure chamber via a second attenuation means; and a connecting member extending through the partition wall so as to be hermetically slidable, the connecting member acting to connect together the first and second resilient members in such a way that these resilient members can move together axially.

Preferably, a spring member is mounted in the second pressure chamber to ensure that the first and second resilient members are moved back and forth about their neutral positions.

In this compressor, the pressure of the working gas inside the working space of the Stirling engine acts on the first and second resilient members through the first pressure chamber and the first buffer chamber to displace these resilient members away from each other, the resilient members being connected together via one rod. The pressure of the fluid inside the fluid circuit acts on the first and second resilient members through the second pressure chamber and the second buffer chamber to displace the resilient members toward each other. Therefore, the force acting on one side of each resilient member is balanced by the force acting on the other side. As a result, it is easy to move the resilient members back and forth about their neutral positions.

Since the gas inside the first buffer chamber can be made to act like a spring, the phase difference between the changing pressure inside the working space of the Stirling engine including the expansion space and the compression space and the displacement of the first resilient member can be easily set to any desired value.

Other objects and features of the invention will appear in the course of the description thereof which follows.

BRIEF DESCRIPTION OF THE DRAWING

The FIGURE is a cross-sectional view of a compressor integral with a Stirling engine, the compressor being fabricated in accordance with the invention.

DETAILED DESCRIPTION OF THE INVENTION

Referring to the FIGURE, a Stirling engine is generally indicated by reference numeral 10. The Stirling engine 10 has a cylinder 11 provided with a hole 11*a*. A displacer piston 12 is inserted in the hole 11*a* so as to be slidable. The inside of the cylinder 11 is partitioned into an expansion space 13 and a compression space 14 by the piston 12. A cooler 15 and a regenerator 16 are mounted on the outer periphery of the cylinder 11 in a coaxial relation to the hole 11*a*. The expansion space 13 is in communication with the compression space 14 via a plurality of heater tubes 17, the regenerator 16, and the cooler 15 in this order. In the present example, the heater tubes 17 extend in a recess formed in a heater 18 located on the top of the cylinder 11. The heater tubes 17 are heated by combustion heat produced from fossil fuel. The working space extending from the expansion space 13 to the compression space 14 is sealed with a working gas such as helium gas.

A crank case 25 is rigidly mounted to the underside of the cylinder 11. A rod 19 which is hermetically inserted in a seal member 23 so as to be slidable protrudes into a crank chamber 24 formed in the crank case 25. The rod 19 is located in the compression space 14 and connected to the displacer piston 12. A yoke cam 20 is firmly mounted on the rod 19, which is connected to an electric motor 22 via the cam 20 and a crank shaft 21. The displacer piston 12 is moved back and forth inside the hole 11*a* by rotating the motor 22.

In the present example, a compression mechanism 30 which acts as the compressor of a well-known Rankine heat pump circuit 29 is spaced from the crank case 25. Alternatively, the compression mechanism 30 is mounted integral with the crank case 25 and hermetically isolated from the crank chamber 24.

The compression mechanism 30 comprises a casing 31 consisting of a cylindrical member 32, a first partition wall member 33 whose one side is coupled to one end of the cylindrical member 32, a first cover member 34, a second partition wall member 35 whose one side is coupled to the other end of the cylindrical member 32, and a second partition wall member 36. The first cover member 34 has an opening which is connected with the other side of the first partition wall member 33. The second cover member 36 has an opening that is connected with the other side of the second partition wall member 35.

A first diaphragm 38, a second diaphragm 40, a third diaphragm 42, and a fourth diaphgram 44 are stretched in the casing 31. The outer fringe of the first diaphgram 38 is hermetically held between the first partition wall member 33 and the first cover member 34, while the inner fringe of the first diaphgram 38 is hermetically held to a plate 37. The outer fringe of the second diaphgram 40 is hermetically held between the first partition wall member 33 and the cylindrical member 32, whereas the inner fringe is hermetically held to a plate 39. The outer fringe of the third diaphragm 42 is hermetically held between the second partition wall member 35 and the second cover member 36, the inner fringe being hermetically held to a plate 41. With respect to the fourth diaphragm 44, the outer fringe is hermetically held between the second partition wall member 35 and the cylindrical member 32, and the inner fringe is hermetically fixed to a plate 43. Thus, the inside of the casing 31 is partitioned into a first pressure chamber 45, a second pressure chamber 46, a first buffer chamber 47, a second buffer chamber 48, a third pressure chamber 49, a fourth pressure chamber 50, and a third buffer chamber 51. A rod 52 extends through the first partition wall member 33 so as to be slidable hermetically. The first diaphragm 38 and the second diaphragm 40 are connected together by the rod 52 so as to be movable together. Another rod 53 extends through the second partition wall member 35 hermetically slidably. The third diaphragm 42 and the fourth diaphragm 44 are connected together by the rod 53 so as to be movable together.

The first pressure chamber 45 is in communication with the compression space 14 through a conduit 26. The second pressure chamber 46 whose volume changes in a complementary relation to the volume of the first pressure chamber 45 is in communication with the Rankine heat pump circuit 29 via an inlet valve 27 and an exhaust valve 28. The second pressure chamber 46 is partitioned from the first pressure chamber 45 by the first diaphragm 38. The pump circuit 29 has a heat exchanger or condenser 30, an evaporator 31, and an expansion valve 32.

The first buffer chamber 47 that is partitioned from the first pressure chamber 45 by the first partition wall member 33 is in communication with the conduit 26 through an orifice 54 and also with a buffer chamber 55 formed in the first partition wall member 33. The second buffer chamber 48 which is partitioned from the first buffer chamber 47 by the second diaphragm 40 is in communication with the second pressure chamber 46 and with the fourth pressure chamber 50 through orifices 90 and 56, respectively.

The third pressure chamber 49, the fourth pressure chamber 50, and the third buffer chamber 51 are also formed similarly. The third pressure chamber 49 is in communication with the conduit 26. The fourth pressure chamber 50 which is partitioned from the third pressure chamber 49 by the third diaphragm 42 is in communication with the atmosphere via an inlet valve 57 and an exhaust valve 58. The fourth pressure chamber 50 varies in volume in a complementary relation to the third pressure chamber 49.

The third buffer chamber 51 which is partitioned from the third pressure chamber 49 by the second partition wall member 35 is in communication with the conduit 26 through an orifice 59 and also with a buffer chamber 60 formed in the second partition wall member 35.

Springs 61, 62, 63 are mounted in the second pressure chamber 46, the second buffer chamber 48, the fourth pressure chamber 50, respectively, to ensure that the first diaphragm 38, the second diaphragm 40, and the third diaphragm 42 are positioned in their neutral positions.

In the operation of the compressor constructed as described thus far, when the electric motor 22 is driven and the heater tubes 17 are heated by the heater 18, the working gas inside the heater tubes 17 is heated. When the displacer piston 12 is moving toward the upper dead point, the working gas inside the expansion space 13 takes up heat via the heater tubes 17 and increases in temperature. Heat is released to, or stored in, the regenerator 16. Then, the gas is cooled by the cooler 15 and goes into the compression space 14. When the displacer piston 12 is traveling toward the lower dead point, the working gas inside the compression space 14 passes through the cooler 15. Then, the gas is elevated in temperature by the regenerator 16. Subsequently, the gas absorbs heat via the heater tubes 17 and further increases in temperature. The gas passes into the expansion space 13 and expands.

In the present example, when the first diaphragm 38 is about to be shifted to the right as viewed in the FIGURE by the pressure of the working gas applied to the second pressure chamber 45 through the conduit 26, the gas in the first buffer chamber 47 serves like a spring. The load of this spring is so set that the phase difference between the changing pressure of the working gas in the expansion space 13 and the compression space 14 and the displacement of the first diaphragm 38 is set to an arbitrary value, for example 90°. Therefore, reciprocation of the displacer piston 12 forms a Stirling cycle. When the piston 12 is moving toward the upper dead point, i.e., in the illustrated condition, the working gas in the expansion space 13 gives up heat in the regenerator 16 and is further cooled by the cooler 15, so that the gas contracts. Then, the gas enters the compression space 14. The pressure of the gas inside the working space drops. When the piston 12 is moving toward the lower dead point, the working gas inside the compression space 14 is increased in temperature and expanded by the regenerator 16 and the heater tubes 17. The gas goes into the expansion space 13 and so the pressure of the working gas inside the working space increases.

Thus, when the displacer piston 12 is moving toward the upper dead point, the first diaphragm 38 is displaced with a given phase difference toward the first pressure chamber 45 by the force that is the resultant of the pressure inside the second pressure chamber 46, the pressure inside the first buffer chamber 47, and the load of the spring 61. At the same time, the inlet valve 27 is opened to force the working fluid such as Freon gas from the Rankine heat pump circuit 29 into the second pressure chamber 46. When the piston 12 is traveling toward the lower dead point, the first diaphragm 38 is displaced with a given phase difference toward the second pressure chamber 46 against the resultant of the pressure inside the second pressure chamber 46, the pressure inside the first buffer chamber 47, and the load of the spring 61. Simultaneously, the exhaust valve 28 is opened, thus forcing the working fluid such as Freon gas from the second pressure chamber 36 into the fluid circuit 29. As a result, the machine acts as a compressor. At this time, if the average pressure of the working gas (or helium gas) inside the working space is different from the average pressure of the working fluid (or Freon gas) inside the Rankine heat pump circuit 29, then the first diaphragm 38 is displaced toward the lower pressure side by the pressure difference. As a result, axial displacement of the first diaphragm 38 in response to changes in the pressure inside the compression space 14 is about to be impeded. In the present example, however, the pressure of the working gas inside the working space of the Stirling engine acts on the first diaphragm 38 and the second diaphragm 40 through the first pressure chamber 45 and the first buffer chamber 47 in such a way that the diaphragms 38 and 40 that are connected together by the rod 52 are displaced away from each other. The pressure of the fluid inside the Rankine heat pump circuit 29 acts on the first diaphragm 38 and the second diaphragm 40 through the second pressure chamber 46 and the second buffer chamber 48 to displace these diaphragms 38 and 40 toward each other. In this way, the force acting on one side of each diaphragm is balanced against the force acting on the other side. Hence, it is easy to move the diaphragms 38 and 40 back and forth about their neutral positions.

Also in the present example, the fourth pressure chamber 50 which produces pumping action simultaneously with the second pressure chamber 46 is formed in a diametrically opposite relationship to the second pressure chamber 46. In consequence, vibration can be suppressed.

As described thus far, in accordance with the present invention, the pressure of the working gas in the working space of the Stirling engine acts on both first resilient member and second resilient member through the first pressure chamber and the first buffer chamber such that these two resilient members connected together via one rod are displaced away from each other. The pressure of the fluid inside the fluid circuit acts on both first and second resilient members through the second pressure chamber and the second buffer chamber in such a manner that these resilient members connected together by the other rod are displaced toward each other. In this way, the force acting on one side of each resilient member is balanced by the force acting on the other side. This makes it easy to reciprocate both resilient members about their neutral positions. The first resilient member can be displaced back and forth axially uniformly on both sides of its neutral position in response to changes in the pressure inside the compression space. Consequently, the best use can be made of the function of the compressor.

Since the gas inside the first buffer chamber can be employed like a spring, the phase difference between the changing pressure inside the working space of the Stirling engine including the expansion space and the compression space and the displacement of the first resilient member can be easily set to any desired value. Therefore, the output of the Stirling engine can be efficiently used in the compressor.

What is claimed is:

1. A compressor integral with a Stirling engine having a cylinder, comprising:

a displacer piston slidably inserted in the cylinder;

an expansion space formed on one side of the piston;

a compression space formed on the other side of the piston, the compression space being in communication with the expansion space through heat transfer tubes, a regenerator, and a cooler, the heat transfer tubes being heated by a heat source;

a first resilient member whose outer fringe is hermetically held to a casing;

a first pressure chamber which is formed on one side of the first resilient member and in communication with the compression chamber;

a second pressure chamber which is formed on the other side of the first resilient member and in communication with a fluid circuit through an inlet-and-exhaust valve mechanism;

a second resilient member whose outer fringe is hermetically held to the casing;

a first buffer chamber formed between one side of the second resilient member and a partition wall formed in the casing, the first buffer chamber being partitioned from the first pressure chamber by the second resilient member, the first buffer chamber being in communication with the compression space via a first attenuation means;

a second buffer chamber which is formed on the other side of the second resilient member and in communication with the second pressure chamber via a second attenuation means; and a connecting member extending through the partition wall so as to be hermetically slidable, the connecting member acting to connect together the first and second resilient members in such a way that these resilient members move together axially.

2. The compressor of claim 1, wherein a spring member is mounted in the second pressure chamber to ensure that the first and second resilient members are displaced back and forth about their neutral positions.

* * * * *